United States Patent [19]

Demny et al.

[11] 4,311,033

[45] Jan. 19, 1982

[54] ROLLING MILL ROLL AND METHOD OF ROLLING

[75] Inventors: Werner Demny; Hermann Möltner, both of Düsseldorf-Oberkassel, Fed. Rep. of Germany

[73] Assignee: Kocks Technik GmbH & Co., Düsseldorf, Fed. Rep. of Germany

[21] Appl. No.: 63,999

[22] Filed: Aug. 6, 1979

[30] Foreign Application Priority Data

Apr. 19, 1979 [DE] Fed. Rep. of Germany ..... 2844042

[51] Int. Cl.[3] ..... B21B 17/00; B21B 27/00

[52] U.S. Cl. ..... 72/224; 29/129.5

[58] Field of Search ..... 72/208, 209, 199, 234, 72/235, 366, 224; 29/129.5

[56] References Cited

U.S. PATENT DOCUMENTS

| | | | |
|---|---|---|---|
| 2,041,937 | 5/1936 | Korbuly | 72/209 |
| 3,618,354 | 11/1971 | Bindernagel et al. | 72/224 |
| 3,688,540 | 9/1972 | Russel | 72/208 |
| 4,044,586 | 8/1977 | Propozi | 72/224 |

FOREIGN PATENT DOCUMENTS

| | | | |
|---|---|---|---|
| 2448158 | 7/1974 | Fed. Rep. of Germany | 72/199 |

*Primary Examiner*—Milton S. Mehr

*Attorney, Agent, or Firm*—Buell, Blenko, Ziesenheim & Beck

[57] ABSTRACT

A rolling mill roll and method of rolling tubes is provided in which the roll has an annular concave working surface in the outer periphery, said surface having a central annular concave portion of a preselected arc and a pair of side edge annular concave portions on each side of said central portion, said side edge portions having an arc of greater radius than the central portion and thus of lesser curvature than the central portion.

8 Claims, 3 Drawing Figures

ROLLING MILL ROLL AND METHOD OF ROLLING

This invention relates to rolling mill roll and method of rolling and particularly to a rolling mill roll and method for the reduction and stretch reduction of a tube.

In the reduction and stretch reduction of tubes with a round cross section, the pass openings formed by the rolls, with the exception of the last ones and in some cases the next to the last ones, are not circular, but they deviate quite markedly from a circular form in the region of the working surface edges of the individual rolls, since the pass widens there.

The purpose of this measure is to prevent longitudinal, toroidal marks on the external tube surface, precisely where the edges of the working surface of the roll have deformed the tube, i.e., in the region of the roll gap. These marks result from the fact that a 100% stretching cannot be achieved during the reduction and stretching-reduction of tubes, but a broadening of the material, i.e., a deformation cross-wise to the direction of rolling, must also be taken into account. The ratio of this broadening to the total deformation is greater, the thinner the walls of the tube to be rolled. Consequently, relatively large expansions of the pass openings are required for thin-wall tube so that the rolled material penetrates only into the expansions and not into the roll gap. In the case of thick wall tubes the broadening is less, such that the expansions in the pass openings can be made correspondingly smaller. The expansions are even disadvantageous in thick wall tubes because out-of-round internal cross sections result as a function of the tube wall thickness and the size of the expansions.

Large expansions of the pass openings are thus required for thin-wall tube, while only small ones are needed in thick-wall tubes. At a given size of the expansions in a pass series, consequently, only tubes from a definite minimum wall thickness up to a definite maximum wall thickness can be flawlessly rolled. If these wall thickness limits are exceeded downward or upward, the above-described disadvantages result.

The invention concerns a rolling mill roll for the reduction and stretching reduction of tubes, the working surface of which is concave in the manner of an arc or an arc-like curve in the region of the roll base, and in the region of its two edges in the sense of an expansion of the pass opening enclosed by several, especially three such rolls.

In the familiar rolling mill rolls of this type an arc or an arc-like curve was selected, which extended over the entire width of the working surface and whose curvature is less than that of the circle inscribed in the pass opening, the so-called inscribed circle that touches the rolls only in the region of the roll base. Such an arc or arc-like curve forms an expansion of the pass opening in the region of the working surface edges.

This familiar rolling mill roll has the disadvantage that the size of the expansions is dependent on the curvature in the region of the roll base and that the size of the expansions cannot thus be arbitrarily chosen and, consequently, only a very limited range of tube wall thicknesses can be satisfactorily rolled.

Thus, in a rolling mill roll that is also familiar the arc or the arc-like curve in the region of the pass opening was not allowed to extend into the zone of the working surface edges, but a tangent was applied to the arc or the arc-like curve for the roll base so that the expansions are rectilinearly limited in the zone of the working surface edges. Because the tangent can be applied at various points of the arc or the arc-like curve of the roll base, expansions of varying size can be provided without having to modify the curvature of the arc or the arc-like curve of the roll base.

However, this familiar rolling mill roll has the disadvantage that it is difficult and expensive to produce. This is particularly true if it is to be finished or reprocessed jointly with the other rolls that form a pass opening, i.e., in the assembled state in the roll stand. Nevertheless, this joint processing is necessary and is now generally practiced in view of the precision required in the dimensions and the form of the pass opening.

The present invention proposes a rolling mill roll that does not have the above shortcomings, but which can be worked in with little cost in the case of pass opening expansions of quite different size.

This problem is solved in accordance with the invention by the fact that the working surface is concave in accordance with a second arc or a second arc-like curve with a lesser curvature in the region of its two edges, and this arc or curve connects directly to the arc or curve of the roll base.

Through the concave shape of the working surface edges according to the invention, a considerably simpler rolling mill roll production is possible because the working surface edges can be processed in an identical manner as the roll base, namely, with a cutting tool that turns concentrically around the roll center. Such a tool can be easily produced and can be held and operated in the cutting position without difficulty. The roll according to the invention also has the advantage that the pass opening expansions can be designed quite arbitrarily large, as a function of the wall thickness required for the tube to be rolled.

Furthermore, a pass opening with which a substantially larger range of tube wall thicknesses can be satisfactorily rolled than is possible with familiar rolls results with the rolling mill rolls according to the invention. This is due to the fact that the shape according to the invention permits curving the pass opening relatively sharply in the region of each roll base on a particularly large section of its periphery and thus obtaining an essentially closed pass in these zones, corresponding to the external diameter of the tube. This is favorable for thick-walled tube in that its internal cross section remains round. The closed design of the pass opening offers no problems in the zone of the roll base in the case of thin-wall tubes. It is decisive for thin-wall tube that sufficient room for broadening is available in the zone of the roll gap, i.e., of the working surface edges, so that the material does not penetrate into the roll gap. This possibility is particularly advantageous, precisely in the case of thin-wall tubes, because the pass opening, which is essentially closed in the roll base, opens quite sharply in the region of the working surface edges due to the invention design and permits the broadening required in the case of thin-wall tubes. Because the region of the working surface edges is not very wide, however, this expansion has no appreciable effect on thick-wall tubes. Consequently, a particularly large wall thickness range can be rolled with the invention roll. It is recommended here that the width of each working surface edge amount to one-sixth of the total working surface width.

In the case of a rolling mill roll that is processed in common with all the rolls forming a pass opening by a tool capable of turning concentrically around the roll center, the working surface edges, according to an advantageous feature of the invention, are processed by a tool with a greater cutting circle and with a greater distance of the cutting plane from the plane of the roll axis, as compared with the middle zone of the working surface. In this manner, the necessary expansion is achieved in the region of the working surface edges by very simple means, independently of the curvature in the region of the roll base.

An implementation example is shown in the drawing.

Figure 1:
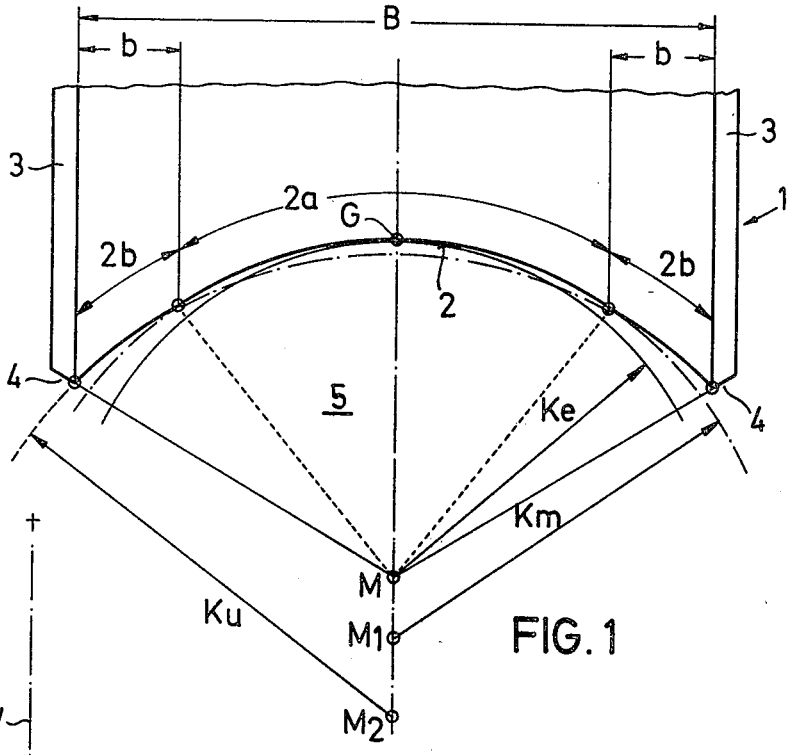
FIG. 1 shows the working surface of a rolling mill roll, viewed in the direction of rolling.

In FIG. 1 a rolling mill roll that is only partially shown is designated by 1. Its working surface 2 extends over almost the entire roll width, such that only the two lateral edges 3 are left over; together with the neighboring rolls (not shown), they form the roll gap at 4. A pass opening 5 is enclosed by the rolling mill roll 1 (shown) and the other, identically designed rolls (not shown).

The midpoint of the pass opening is marked at M, through which the longitudinal central axis of the tube to be rolled and thus the roll pass center Wm (see FIG. 2) runs vertical to the paper plane. The roll base lies at G, i.e., the site where the working surface 2 is cut the deepest into the rolling mill roll 1. An inscribed circle $K_e$ around the midpoint M touches the working surface 2 in the pass base G. The entire width of the working surface 2 is designated in FIG. 1 by B, from which the working surface edges b, which constitute approximately one-sixth of the entire width B, are to be distinguished.

The arc-like curve of the working surface 2, in the manner of which the working surface 2 is curved in the region of the roll base G, is designated by 2*a*. 2*b* designates the arc-like curves that determine the shape of the working surface 2 in the region of the working surface edges b.

The arc-like curves 2*a* and 2*b* correspond only approximately to a circle $K_m$ or $K_u$ with midpoints $M_1$ and $M_2$, which do not lie in the midpoint M of the pass opening 5, thus on the roll pass center Wm.

Figure 2:
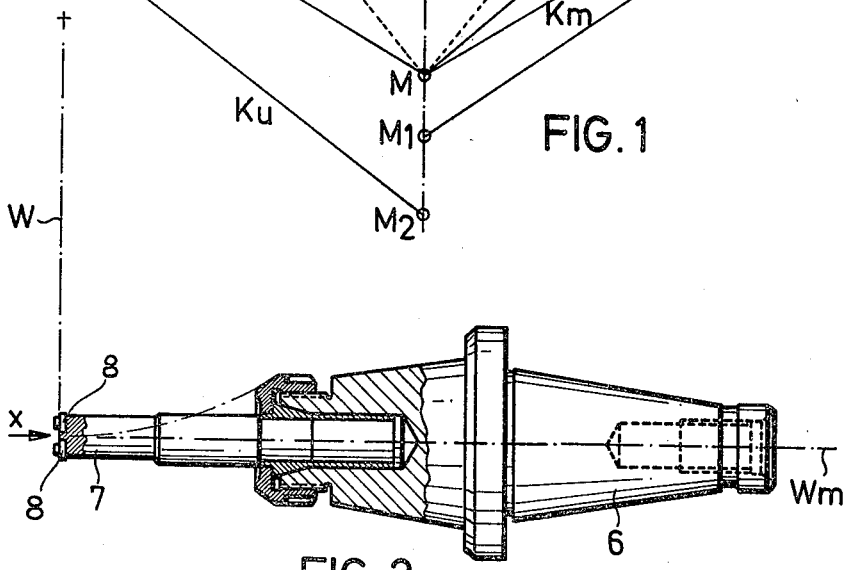
FIG. 2 shows a portion of the roll according to FIG. 1 in side view, along with a processing tool.
Figure 3:
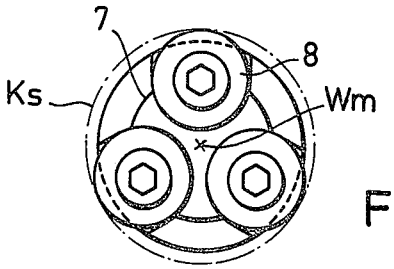
FIG. 3 shows the processing tool, viewed from the direction of the arrow X of FIG. 2.

FIG. 2 shows how these arc-like curves 2*a* and 2*b* are formed. This figure shows the roll center Wm and, concentric to it, a tool holder 6 that can be displaced axially and is capable of turning around the roll pass center Wm. It carries a tool 7, which has circular cutting disks 8 that are replaceable, as can be seen in FIG. 3 in particular.

If the cutting edges of the cutting disks 8—the cutting plane—are precisely in the transverse center plane of the roll axis W, a circular pass opening corresponding to the inscribed circle $K_e$ results. If the tool holder 6 and thus the tool 7 are moved in the direction of the arrow X and the cutting disks 8 are allowed to cut with some distance from the plane of the roll axis W, i.e., on a cutting circle that is somewhat larger than the inscribed circle $K_e$, the arc-like curve 2*a* is formed in the region of the roll base G, thus in the central region of the working surface 2. The circle that is designated in FIG. 3 by $K_s$ is understood to be the cutting circle. The arc-like curves 2*b* in the region of the working surface edges b are formed through an additional axial movement of the tool holder 6 and/or tool 7 in the direction of the arrow X and by using an even larger cutting circle $K_s$.

In the foregoing specification I have set out certain preferred practices and embodiments of my invention; however, it will be understood that this invention may be otherwise embodied within the scope of the following claims.

We claim:

1. In a rolling mill roll for the reduction and stretch-reduction of tubes having a roll engaging the work and exerting tension on the work whose central working surface has a concave work engaging curvature in the form of an arc or an arc-like curve in the region of the roll base and is designed in the region of its two edges in the sense of an expansion of the pass opening enclosed by three such rolls, the improvement comprising the working surface in the region of its two edges is concave in the manner of a second arc or a second arc-like curve with a lesser curvature than the central working surface, and this second arc on each side of the working surface joins directly to the central arc of the roll base intermediate the center of the roll and the outside edge of the roll on each side and forms the balance of the roll surface and constitutes a minor portion of the roll surface.

2. Rolling mill roll according to claim 1, characterized in that the width of each working surface edge is approximately one sixth of the overall working surface width.

3. A rolling mill roll for the reduction and stretch reduction of tubes comprising a cylindrical roll member having an annular concave working surface in the outer periphery, said surface having a central annular concave portion of a preselected arc forming a major surface of the roll and engaging the work piece and exerting tension thereon and a pair of side edge annular concave portions on each side of and intersecting said central portion, said side edge portions having an arc of greater radius than the central portion and thus of lesser curvature than the central portion and extending from a point intermediate the center line of the roll and each outside edge of the roll and forming the balance of the roll surface and constitutes a minor portion of the roll surface.

4. A rolling mill roll as claimed in claim 3 wherein each of said side edge concave portions is about one-sixth of the total working surface formed by the combined central and side portions.

5. A method of stretch reducing tubes to prevent rolling longitudinal marks on the exterior tube walls comprising the steps of passing a tube to be reduced through a pass opening formed by a plurality of generally opposed cylindrical driven rolls, said rolls having an annular concave working surface on the periphery in contact with the tube to be reduced, said working surface having a central annular concave portion of a preselected arc forming a major portion of the roll surface engaging the tube to be reduced and exerting tension thereon and a pair of side edge annular concave portions, one on each side of the central portion, said side edge portion having an arc of greater radius than the central portion and extending from a point intermediate the center line of the roll and each outside edge of the roll and forming the balance of the roll surface as a minor portion of the roll surface.

6. A method as claimed in claim 5 wherein each of the side edge portions forms about one-sixth of the total working surface.

7. In a rolling mill roll for the reduction and stretch-reduction of tubes having a roll engaging the work and exerting tension on the work whose central working surface has a concave work engaging curvature in the form of an arc or an arc-like curve in the region of the roll base and is designed in the region of its two edges in the sense of an expansion of the pass opening enclosed by three such rolls, the improvement comprising the working surface in the region of its two edges is concave in the manner of a second arc or a second arc-like curve with a lesser curvature than the central working surface, and this second arc on each side of the working surface joins directly to the central arc of the roll base intermediate the center of the roll and outside edge of the roll on each side and forms a minor portion of the roll surface, which roll is processed, together with all the rolls forming a pass opening, in common by a tool capable of rotating concentrically around the roll center, characterized in that the working surface edges, in comparison with the central zone of the working surface, are processed with a tool with a greater cutting circle and with a greater spacing of the cutting plane from the plane of the roll axis.

8. In a rolling mill roll for the reduction and stretch-reduction of tubes having a roll engaging the work and exerting tension on the work whose central working surface has a concave work engaging curvature in the form of an arc or an arc-like curve in the region of the roll base and is designed in the region of its two edges in the sense of an expansion of the pass opening enclosed by three such rolls, the improvement comprising the working surface in the region of its two edges is concave in the manner of a second arc or a second arc-like curve with a lesser curvature than the central working surface, and this second arc on each side of the working surface joins directly to the central arc of the roll base intermediate the center of the roll and outside edge of the roll on each side and forms a minor portion of the roll surface, the width of each working surface edge being approximately one sixth of the overall working surface width and having been processed, together with all of the rolls forming a pass opening, in common by a tool capable of rotating concentrically around the roll center, characterized in that the working surface edges, in comparison with the central zone of the working surface, are processed with a tool with a greater cutting circle and with a greater spacing of the cutting plane from the plane of the roll axis.

* * * * *

UNITED STATES PATENT AND TRADEMARK OFFICE

CERTIFICATE OF CORRECTION

PATENT NO. : 4,311,033

DATED : Jan. 19, 1982

INVENTOR(S) : WERNER DEMNY and HERMANN MOLTNER

It is certified that error appears in the above-identified patent and that said Letters Patent are hereby corrected as shown below:

On the Title page, the priority date of "Apr. 19, 1979" is incorrect and should be --Oct. 9, 1978--.

Signed and Sealed this

*Twelfth* Day of *April 1983*

[SEAL]

*Attest:*

GERALD J. MOSSINGHOFF

*Attesting Officer*

*Commissioner of Patents and Trademarks*